US005466063A

United States Patent [19]

Poyet et al.

[11] Patent Number: 5,466,063

[45] Date of Patent: Nov. 14, 1995

[54] DEVICE FOR CONTINUOUSLY MIXING LIQUID ADDITIVES INTO A FLUID

[75] Inventors: Georges Poyet, Les Loges en Josas; Frédéric Badier, Buc; Dominique Guillot, Saint Etienne, all of France

[73] Assignee: Dowell Schlumberger Incorporated, Sugar Land, Tex.

[21] Appl. No.: 313,034

[22] PCT Filed: Mar. 15, 1993

[86] PCT No.: PCT/FR93/00256

§ 371 Date: Sep. 23, 1994

§ 102(e) Date: Sep. 23, 1994

[87] PCT Pub. No.: WO93/18848

PCT Pub. Date: Sep. 30, 1993

[30] Foreign Application Priority Data

Mar. 23, 1992 [FR] France ..... 92 03577

[51] Int. Cl.[6] ..... B28C 5/46; B01F 15/02

[52] U.S. Cl. ..... 366/6; 137/599.1; 137/888; 366/40; 366/159.1; 366/163.2

[58] Field of Search ..... 366/163.1, 163.2, 366/40, 34, 36, 6, 2, 131, 136, 137, 159.1, 154.1, 150.1; 137/599.1, 888

[56] References Cited

U.S. PATENT DOCUMENTS

| | | | |
|---|---|---|---|
| 4,416,610 | 11/1983 | Gallagher | 137/888 |
| 4,781,467 | 11/1988 | Williams | 137/599.1 |
| 5,118,197 | 6/1992 | Ellenberger | 366/40 |
| 5,344,619 | 9/1994 | Larwick | 366/163.2 |
| 5,388,905 | 2/1995 | Ake | 137/888 |

FOREIGN PATENT DOCUMENTS

| | | |
|---|---|---|
| 445875 | 9/1991 | European Pat. Off. . |
| 898995 | 7/1949 | Germany . |
| 1557043 | 3/1970 | Germany . |
| 2934087 | 3/1981 | Germany . |
| 298515 | 7/1954 | Switzerland . |
| 559574 | 3/1975 | Switzerland . |
| 514786 | 11/1939 | United Kingdom . |
| 976578 | 11/1964 | United Kingdom . |

OTHER PUBLICATIONS

Patent Abstracts of Japan, vol. 13, No. 238, (C–603) (3586) (Jun. 5, 1989); Japan 10 47 430 to Hideteru Sawa of Feb. 21, 1989.

*Primary Examiner*—Robert W. Jenkins
*Attorney, Agent, or Firm*—Spencer, Frank & Schneider

[57] ABSTRACT

This invention concerns a device for continuously injecting liquid additives into a fluid.

The device includes a jet eductors system for prediluting the additives.

Applications in the oil and related industries, the building industry and similar. FIG. 1

6 Claims, 4 Drawing Sheets

DEVICE FOR CONTINUOUSLY MIXING LIQUID ADDITIVES INTO A FLUID

BACKGROUND OF THE INVENTION

The present invention relates to a device for injecting, in a continuous and homogeneous manner, one or several liquid additives into a main fluid circulating in a conduit.

A problem, both serious and well-known for a very long time, in particular in the oil and related industries as well as the industrial cleaning and the building industries, resides in the great difficulty of injecting a quantity of liquid or semi-liquid additives into a main fluid in a precise and continuous manner.

It is imperative to dosage the additive with precision, i.e. to very precisely control the flow rate, the quantity, and the homogeneity of the performed injections.

This has become so much more important since mathematical models, sensors, operating software and data processing all allow a very high precision to be reached in these operations. Thus, the precision limits are more and more frequently the precision limits imposed by the injection of the additives.

SUMMARY OF THE INVENTION

According to the present invention, the additives are injected after pre-diluting in a fraction derived from the main fluid stream.

All devices allowing such derivation and predilution operations are appropriate for performing the invention.

DESCRIPTION OF THE PREFERRED EMBODIMENT

Figure 1:
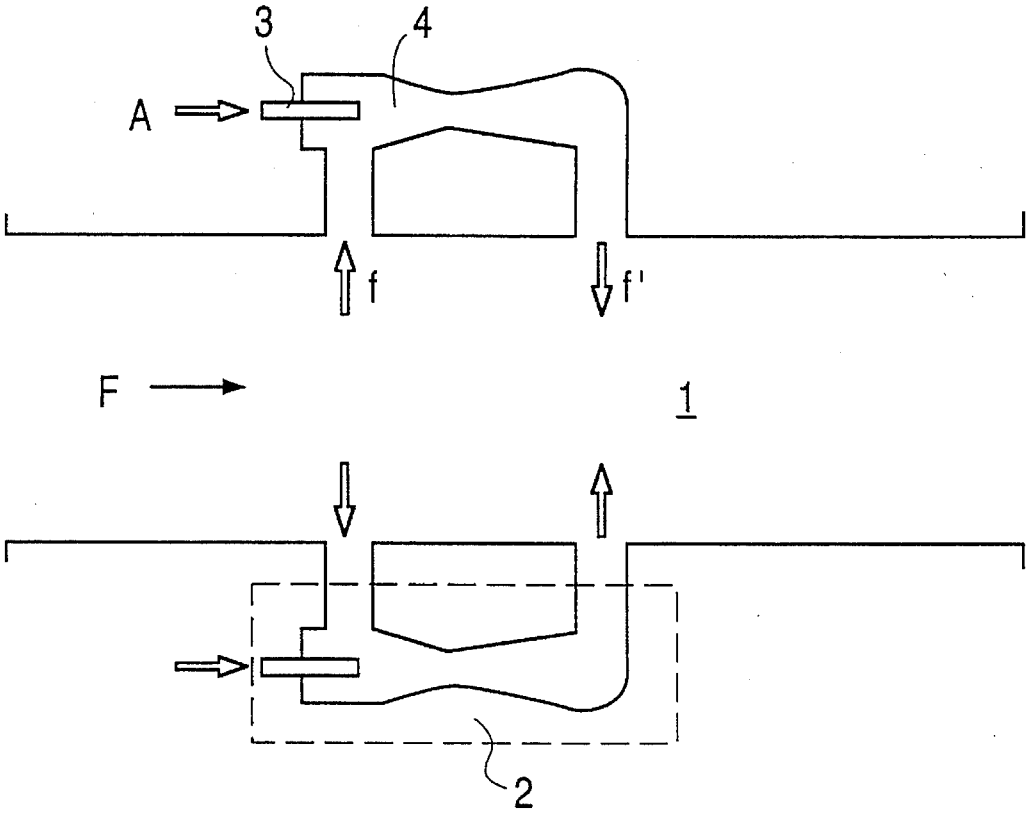
FIG. 1 illustrates a preferred embodiment of the invention.

FIG. 1 illustrates a system where jet eductors (2) are radially arranged around the conduit (1) in which the main fluid (F) circulates.

Each eductor is by-pass mounted and includes an inlet tubing (3) for the liquid or semi-liquid additive (A).

The jet eductor principle is known. In the present invention, a fraction of the fluid (F) is derived (f) by suction out of the main stream (F) and is mixed, in the mixing chamber (4), with the additive injected in (3). This mix, which thus consists of additive (A) pre-diluted in the fluid (F), is introduced again (f') into the main stream.

A very substantial improvement in the injection precision, as compared with traditional systems, is ascertained.

Example: Cement slurry

The test was conducted, with a marker product ($CuSO_4$) dispersed in the additive, by recording the marker concentration.

The same injection also was conducted, in a traditional manner, with coaxial injection (i.e. injection of the additive through a conduit coaxial with conduit 1) or lateral injection (i.e. injection through a lateral conduct open in conduct 1).

In all three cases, the injection was performed into the fluid suction conduit of a vortex type VIP™ Mixer.

The characteristics of the thus prepared slurry were as follows:

flow rate: 4 bpm density: 15 ppg water suction flow rate (at the VIP Mixer inlet): 2.5 bpm.

Figure 2:
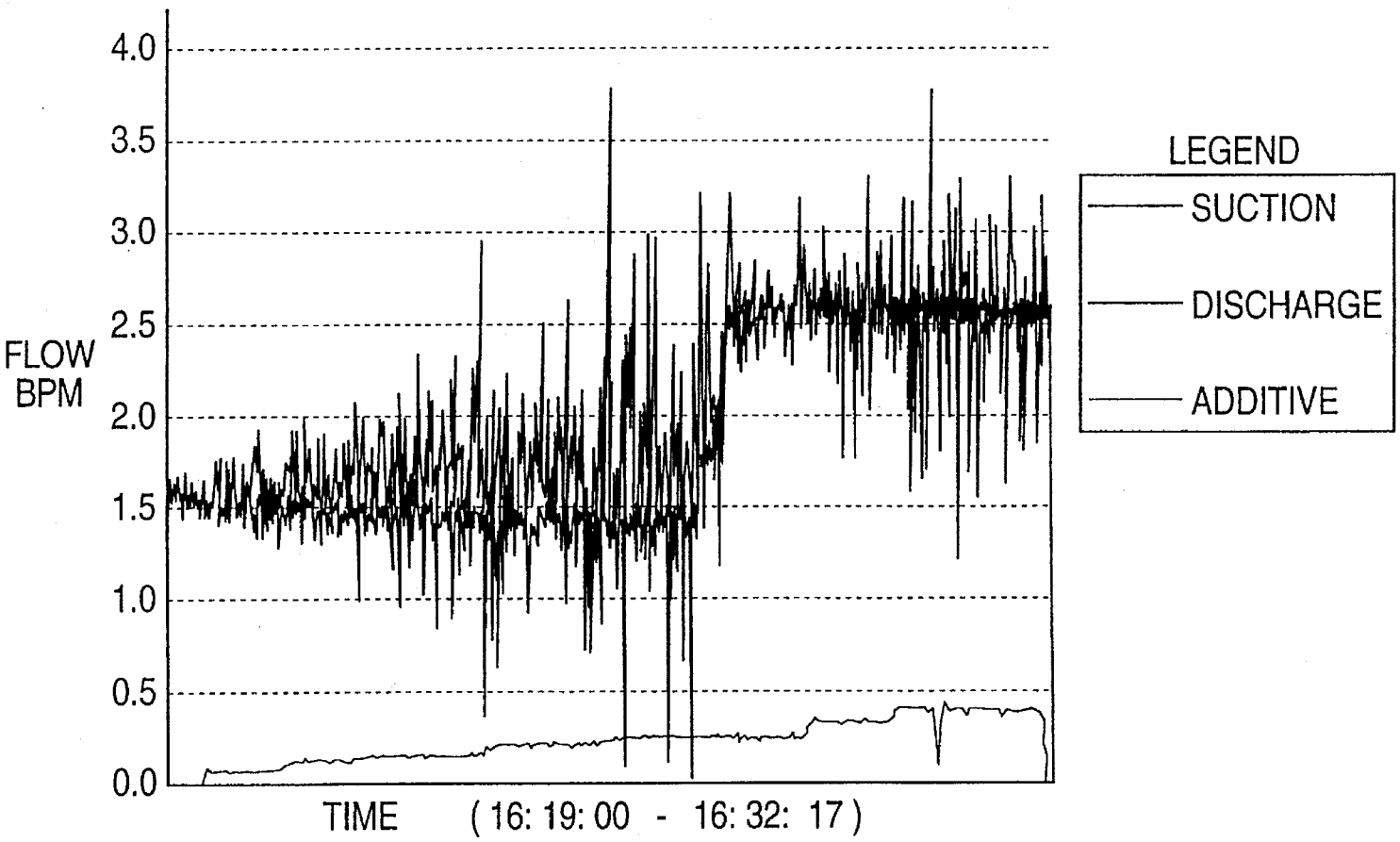
FIG. 2 PRIOR ART
FIG. 2 and FIG. 3 graphically illustrate the prior art injection characteristics.
Figure 3:
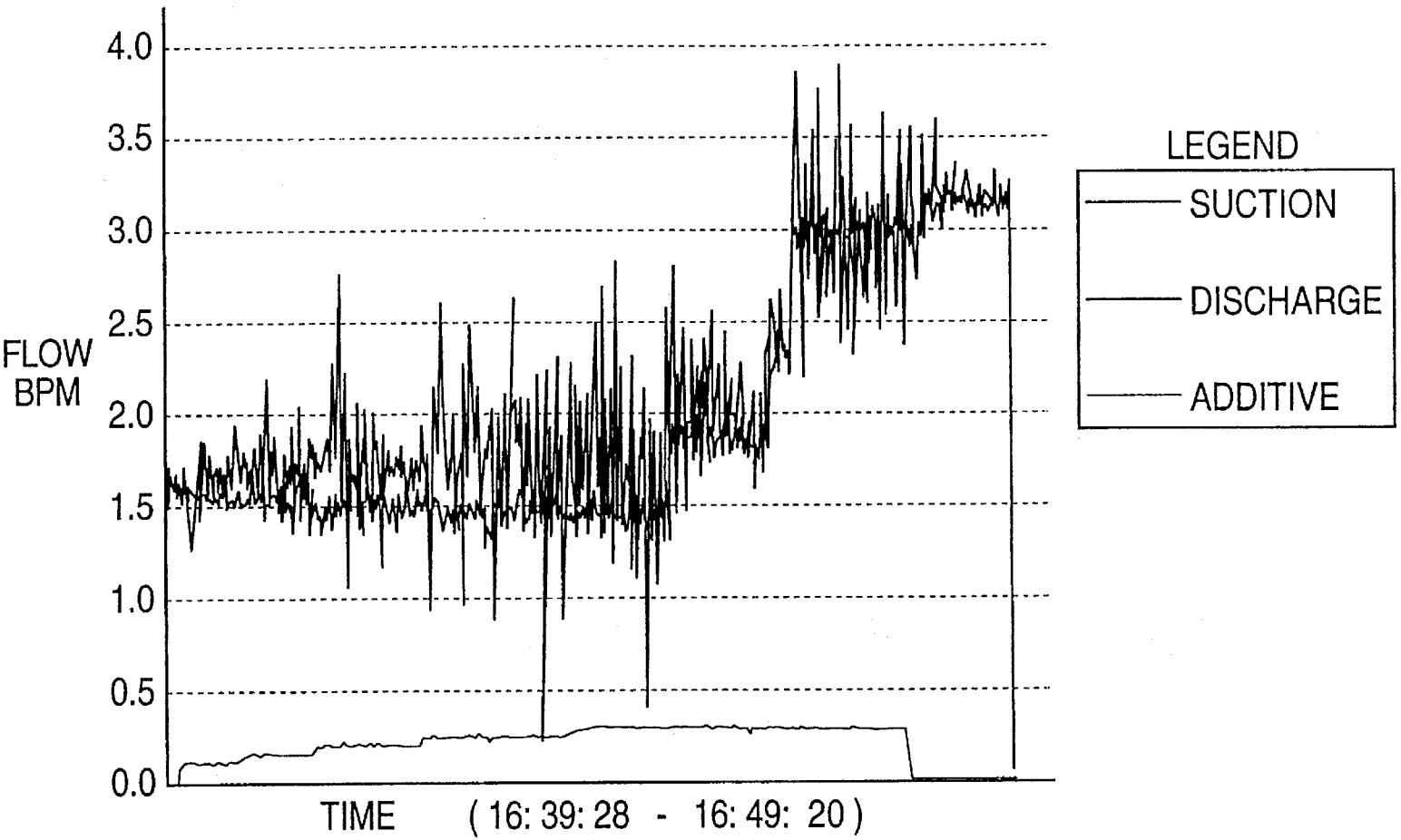
FIG. 3 PRIOR ART
Figure 4:
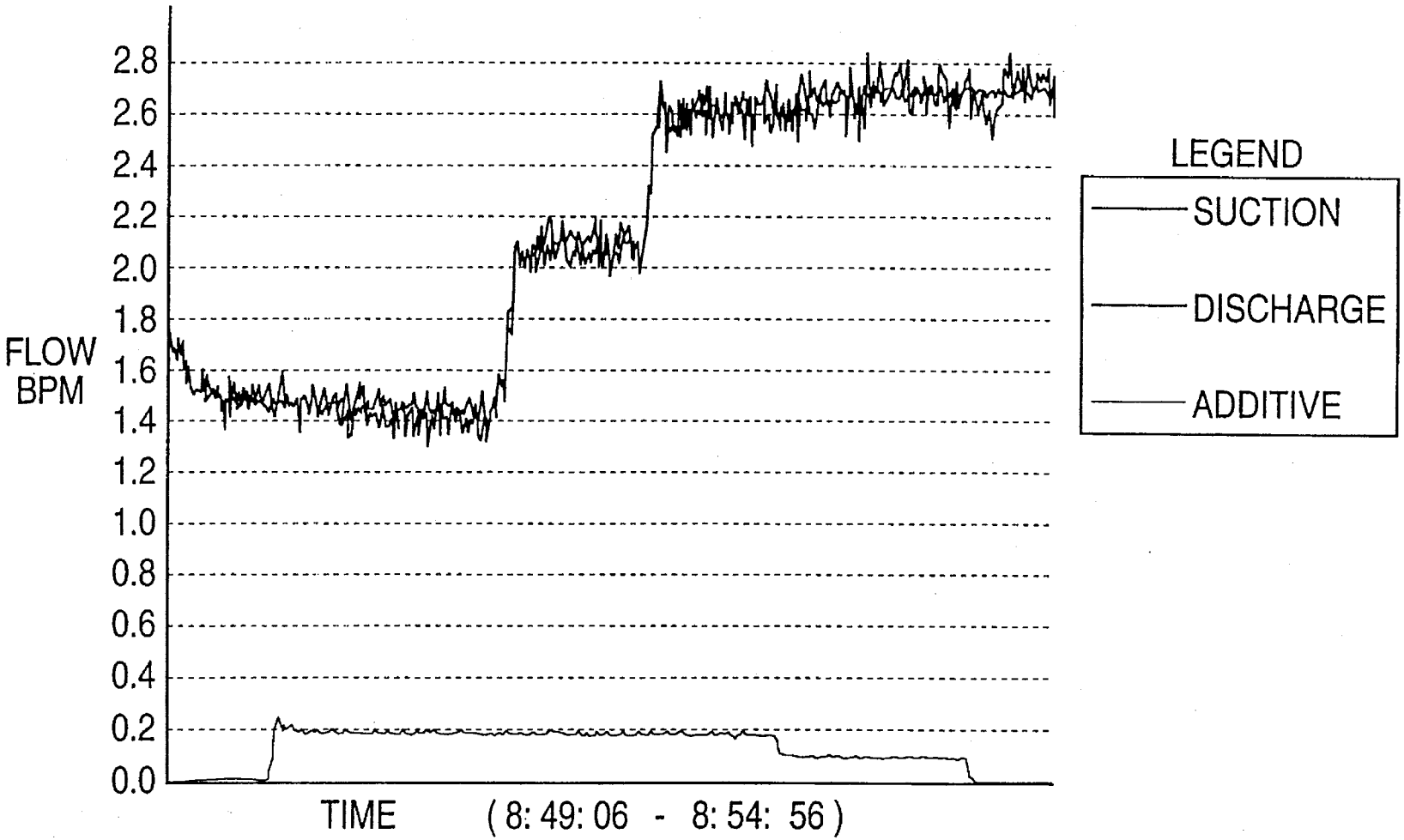
FIG. 4 graphically illustrates the injection characteristics of the present invention.

The results are represented in FIG. 2 for the coaxial injection in FIG. 3 for the lateral injection (with a 90° angle between injecting direction and conduit 1)

in FIG. 4 for the injection using the device according to the invention.

An extremely marked improvement of the injection quality is noted.

The VIP Mixer is a rotary, continuously operating, vortex mixer, described in European patent application EP N° 91200440.5.

The invention also is particularly useful for preparing drilling muds or fluids.

Another, particularly promising, application aspect concerns the continuous dosage of additives in the separation fluids, or "spacers", in the oil industry. The invention for the first time allows continuously varying the "spacer" properties, instead of step by step variations. This results in a very important difference in terms of the operation quality.

We claim:

1. A method of continuously injecting additives into a continuous mixer having a conduit, comprising the steps of:

circulating a fluid through the conduit;

arranging at least one jet eductor on a periphery of the conduit;

drawing a portion of the fluid from the conduit into the jet eductor;

mixing the portion with an additive in the jet eductor to obtain a mixture; and continuously injecting the mixture from the jet eductor into the fluid.

2. A method as defined in claim 1, wherein said arranging step includes providing a plurality of jet eductors radially arranged around the periphery of the conduit.

3. A device for mixing additives into a circulating fluid, comprising:

a continuous mixer having a conduit, the fluid circulating through said conduit; and at least one jet eductor arranged on a periphery of said conduit and having a suction opening and a separate discharge opening each being in communication with said conduit, said jet eductor further comprising an additive opening in a region of the suction opening, and a mixing chamber located between the suction opening and the discharge opening, the fluid being drawn from said conduit through the suction opening and into said jet eductor to be mixed in said mixing chamber with an additive injected through the additive opening to form a mixture, the mixture being continuously injected into the fluid through the discharge opening.

4. A device as disclosed in claim 3, wherein said at least one jet eductor comprises two jet eductors radially arranged around the periphery of said conduit.

5. A method of preparing one of a cement slurry and drilling mud, comprising the steps of:

providing a continuous mixer with a conduit;

circulating a fluid through the conduit;

arranging at least one jet eductor on a periphery of the conduit;

drawing a portion of the fluid from the conduit into the jet eductor;

mixing the portion with an additive in the jet eductor to obtain a mixture; and continuously injecting the mixture from the jet eductor into the fluid to form the one of cement slurry and drilling mud.

6. A method as defined in claim 5, wherein said arranging step includes providing a plurality of jet eductors radially arranged around the periphery of the conduit.

* * * * *